US006013307A

United States Patent [19]

Hauser et al.

[11] Patent Number: 6,013,307

[45] Date of Patent: Jan. 11, 2000

[54] METHOD OF PRODUCING FORGERY-PROOF COLORED PRINTED ARTICLES

[75] Inventors: Hanspeter Hauser, Aesch; Werner Helmut Gerber, Riehen; Abul Iqbal, Arconciel, all of Switzerland; Pierre Maurer, Rixheim, France

[73] Assignee: Ciba Specialty Chemicals Corporation, Tarrytown, N.Y.

[21] Appl. No.: 08/159,405

[22] Filed: Nov. 30, 1993

[30] Foreign Application Priority Data

Dec. 30, 1992 [EP] European Pat. Off. ..... 92 810 951

[51] Int. Cl.[7] ..... B41M 3/14

[52] U.S. Cl. ..... 427/7; 427/157

[58] Field of Search ..... 427/7, 157

[56] References Cited

U.S. PATENT DOCUMENTS

| | | | |
|---|---|---|---|
| 4,066,280 | 1/1978 | LaCapria | 427/7 |
| 4,277,514 | 7/1981 | Sugiura et al. | 427/7 |
| 4,387,112 | 6/1983 | Blach | 427/7 |
| 4,540,595 | 9/1985 | Acitelli et al. | 427/157 |
| 5,160,171 | 11/1992 | Gregory | 427/7 |

FOREIGN PATENT DOCUMENTS

| | | |
|---|---|---|
| 518156 | 9/1981 | Austria . |
| 0428828 | 5/1991 | European Pat. Off. . |
| 1407065 | 9/1975 | United Kingdom . |

OTHER PUBLICATIONS

"Neue Effektpigmente gegen Raubkopierer", *Phanomen Farbe*, Oct. 1992, pp. 34–35.

*Primary Examiner*—Janyce Bell
*Attorney, Agent, or Firm*—Michele A. Kovaleski

[57] ABSTRACT

In order to prevent or at least render difficult the copying of colored printed security papers, for example banknotes, the printing inks used for printing are so formulated that copies made using customary color copiers produce a markedly different color impression and can therefore easily be identified as being forgeries. This is achieved by using for the formulation of the printing inks dyes (pigments) that are as different as possible from the dyes (toners) customarily used in conventional color copiers. The choice of the dyes for the formulation of the printing inks is especially such that there is the greatest possible degree of metamerism between the printing ink in question and the match of the relevant master color using the dyes of the color copier. Preferably non-amorphous or anisotropic black dyes and effect dyes, especially fluorescent effect dyes, are co-used for the formulation of the printing inks.

8 Claims, 1 Drawing Sheet

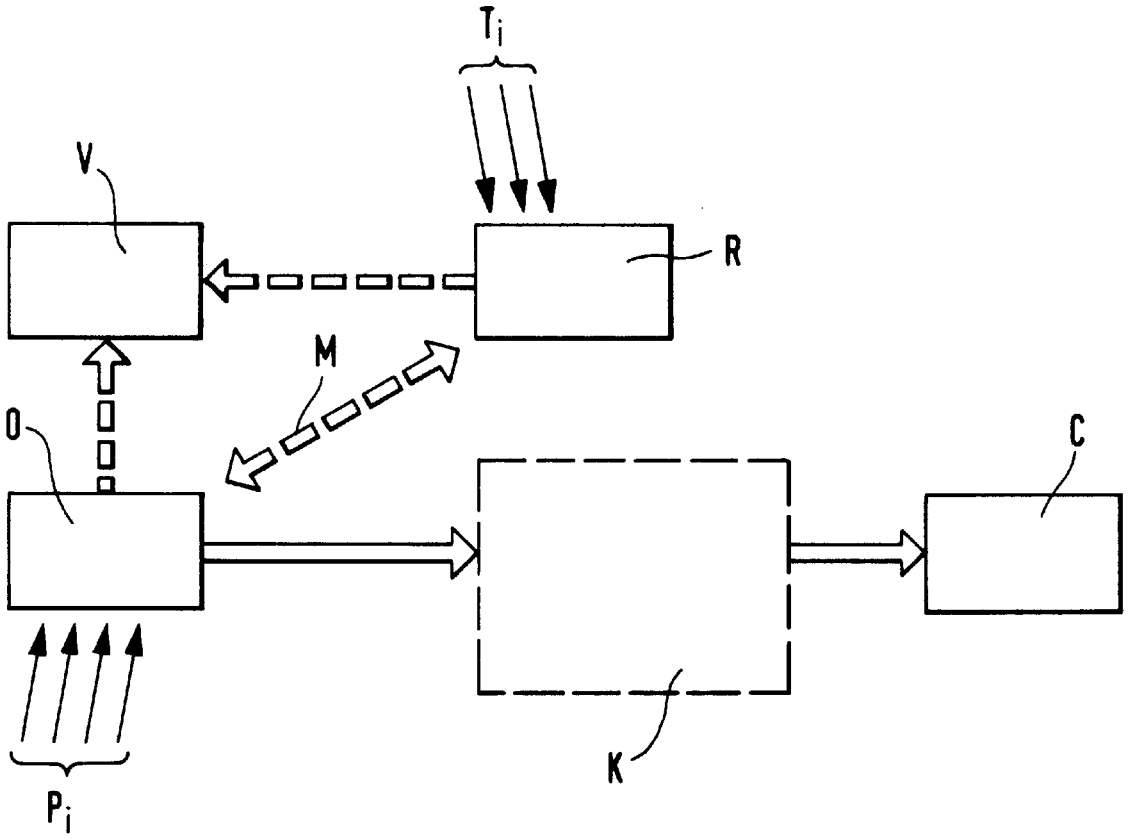
$T_i$
V
R
M
O
C
K
$P_i$

METHOD OF PRODUCING FORGERY-PROOF COLORED PRINTED ARTICLES

The invention relates to a method of producing forgery-proof coloured printed articles, that is to say coloured printed articles, especially security papers, that cannot be reproduced in their true colours using colour copiers.

Coloured printed articles that fluoresce when irradiated with UV light are known, for example, from AU-A-518 156. It is also known from GB-A-1 407 065 to print sensitive documents, inter alia security papers or bank notes, at least in some areas with a pair of metameric printing inks in such a manner that the metameric colours are printed next to one another on the document. In daylight those colours are virtually indistinguishable from one another in appearance but when illuminated with UV light the two colours appear different. Furthermore, it is known from EP-A-0 428 828 to print a ticket with a fluorescent colour and a non-fluorescent colour which are virtually indistinguishable from one another in appearance in daylight. If an attempt is made to copy such tickets the fluorescent colour is falsely reproduced. In the case of the other publications mentioned, the documents can be identified as being forgeries only with the aid of technical aids (UV light) and therefore fall only into identification category 2 or 3 in which technical aids (for example UV light) are always necessary to distinguish a forgery or copy from an original.

Copiers capable of colour copying are becoming increasingly widespread and have become so efficient, especially in terms of their colour reproduction, that they entirely fulfil most ordinary requirements, especially everyday office requirements. An unfortunate consequence of this is that such copiers are more and more frequently being misused for the purpose of forging security papers, especially banknotes, that fall into identification category 1 in which it should be possible to establish authenticity by 1 to 3 seconds' visual inspection without the use of technical aids.

The aim of the invention is to provide a possible way in which such misuse of colour copiers can be if not prevented then at least rendered useless.

In accordance with the general concept of the invention, that aim is achieved by printing The coloured printed articles, the forgery of which using copiers is to be prevented or rendered useless, with printing inks that cannot be readily reproduced using conventional colour copiers. Colour copies made on the colour copiers are then clearly distinct from the originals in terms of colour, that is to say in terms of hue, saturation and lightness, and are therefore easily identified as being forgeries.

The procedure is more specifically as follows: at least one characteristic area of the printed article is printed with a printing ink which, for the purpose of achieving a desired master colour, is so formulated from a single dye or from a mixture of two or more dyes that there is a visually clearly identifiable difference between the visual colour impression of the characteristic area of the original printed article that has been printed with that printing ink and the visual colour impression of the corresponding area of a colour copy made from the original printed article using a colour copier.

For the formulation of the printing ink there are especially used dyes which have optical data (absorption/scattering as a function of wavelength) clearly different from the optical data of the dyes (toners) customarily used in colour copiers.

Especially suitable dyes are the pigments marketed by Ciba-Geigy under the trademarks IRGAZIN® Gelb (Yellow) 2RLT (isoindolinone pigment, CI PY 110, CI No. 56280); IRGAZIN® Gelb (Yellow) 3RLTN (isoindolinone pigment, CI PY 111, CI No. 57280); CROMOPHTAL® Orange 2G (isoindolinone pigment, CI PO 61, CI No. 11265); CROMOPHTAL® Braun (Brown) 5R (azo condensation pigment, CI PBr 23, CI No. 20060); CROMOPHTAL® Orange GP (azo coupling pigment, CI PO 64, CI No. 12760); CROMOPHTAL® Scharlach (Scarlet) RN (azo condensation pigment, CI PR 166, CI No. 20730); CROMOPHTAL® Orange Rot (Red) G (azo condensation pigment, CI PR 220, CI No. 20055); CROMOPHTAL® DPP Rot (Red) BP (diketo-pyrrolo-pyrrole pigment, CI PR 254); CROMOPHTAL® Violett (Violet) B (dioxazine pigment, CI PV 37, CI No. 51345); IRGALITH® Grün (Green) GLN (Cu-phthalocyanine (halogenated) pigment, CI PG7, CI No. 74260); and IRGALITH Grün (Green) 6G (Cu-phthalocyanine pigment, CI PG 36, PI No. 74265).

In accordance with an especially advantageous variant of the method according to the invention, the formulation of the printing ink necessary for obtaining a desired master colour is effected by first creating a reference or a match of the desired master colour either by matching the master colour using the dyes customarily used in a colour copier or dyes similar thereto or by making a colour copy of the master colour using the colour copier. The formulation of the printing ink is then effected with the proviso that, on the basis of two selected types of illumination, there is obtained the greatest possible degree of metamerism between the formulated printing ink or the area of the original printed article printed using that printing ink, on the one hand, and the reference or match of the master colour, on the other hand, so that there is a visually clearly identifiable difference between the visual colour impression of the characteristic area of the original printed article printed with that printing ink and the visual colour impression of the corresponding area of a colour copy made from the original printed article using a colour copier.

In accordance with a further aspect of the invention, especially clear differences between the original printed article and copies made therefrom can be achieved when non-amorphous or anisotropic black dyes and effect dyes, especially fluorescent dyes, are at least co-used in the formulation of the printing inks. The pigments marketed by Ciba-Geigy under the trademarks GRAPHITAN® 7700 (graphite pigment, CI PBI 10, CI No. 77265) and IRGAZIN® Fluorescent Gelb (Fluorescent Yellow) 8501B (benzimidazole pigment, CAS No. 40382-92-1) are preferred.

Further aspects and details of the invention will be found in the detailed explanation given below.

Here and hereinbelow the term "printing ink" is to be understood as being the physical ink (in liquid or paste form) that is applied to the substrate, generally special banknote paper, by means of a suitable printing process (intaglio printing, offset printing etc.). "Dyes" are to be understood as being the constituents of a printing ink that produce the colour effect of that printing ink; dyes are generally colour pigments or carbon black (black dye). "Colour" is to be understood as being the visually and colorimetrically detectable colour impression that is produced by a printing ink or by a substrate printed therewith. "Formulation" is to be understood as being the composition of a printing ink in terms of the nature and amount of dyes as well as the process of determining from a given range of dyes the composition suitable or necessary for obtaining (matching) a desired master colour (a desired colour impression). The dyes customarily used in a colour copier are referred to as "toners" below for the purposes of better differentiation. Colour copiers generally operate with three coloured toners (yellow, cyan and magenta) and most also have a black toner.

For the purposes of formulation, known computer-aided formulation systems are available, which systems have stored in them the optical data of the range of dyes used and reproduce with predeterminable accuracy the spectrum of the master colour (the spectrum being predetermined or measured, for example, using a spectral photometer) by means of more or less perfected algorithms by combining the various dyes from the stored range. The result of formulation is the composition of the printing ink in terms of the nature and the proportions of the individual dyes. A known formulation program of this type is the software issued by Ciba-Geigy under the name "CGREC®", which is geared to the Applicants' range of pigments and which can be run on any personal computer, optionally in conjunction with a spectral photometer. According to the matching accuracy requested, formulation systems generally provide several formulations, possibly using different dyes, that all accord with the master colour within the predetermined tolerance. The choice of the most suitable formulation is then made in accordance with other criteria which are of no importance here. Many formulation systems also allow the determination of the degree of metamerism between the master colour and the formulated dye mixture, that is to say the matching of the master colour.

The term "metamerism" with respect to two defined types of illumination is to be understood qualitatively, as is known, as being the difference in colour between two physical colours (for example printing inks or printed surfaces or the like) under one of the defined types of illumination when those same two physical colours have no difference in colour under the other of the two defined types of illumination. The metamerism can be determined quantitatively by means of known calculation methods (for example in accordance with DIN 6172) unambiguously from the spectra of the two colours under the two defined types of illumination. Spectral photometers can be used to determine the spectra, while the metamerism is calculated in accordance with known formulae, advantageously using the calculation programs available for that purpose. The types of illumination generally used as a basis are daylight (D65) and incandescent lamp light (A) in accordance with the standards of the CIE.

Coloured security papers, for example banknotes and the like, generally have a number of characteristic coloured areas in their design or are printed as a whole in characteristic colours that are kept constant within narrow limits. In order that forgeries made using colour copiers can easily be identified it is crucial that those characteristic coloured areas cannot be copied in a manner true to the original, that is to say in their true colours, using a colour copier. In accordance with the general concept of the invention, those areas of the security paper are printed with special printing inks which can be reproduced either not at all or only very poorly by means of customary colour copiers, so that the copies so made are therefore clearly different in colour, that is to say in terms of hue/shade, saturation and lightness, from the original printed article and can be identified as being forgeries.

In accordance with the invention, starting from the respective master colours those special printing inks are so mixed (formulated) from various dyes (pigments) that the dyes participating in the formulation in question are as far removed as possible in terms of their spectral properties (absorption and scattering as a function of wavelength) from the dyes (toners) customarily used in colour copiers.

BRIEF DESCRIPTION OF THE DRAWINGS

The FIGURE is a schematic of a process for determining formulations in terms of copying characteristics.

However, there are generally many possible different formulations for the matching of a desired master colour and it is not possible without laborious testing (printing, copying) to identify at the outset how those various formulations will behave on being copied using a colour copier K. Surprisingly it has now been found that a prediction can be made in this respect by taking into account also the metamerism M or the index of metamerism $M_i$ or an analogous value (see FIGURE), the metamerism in question being not the metamerism between the relevant printing ink formulations $P_1, P_2 \ldots P_n$ and the master colour V but the metamerism of the respective formulation $P_i$ (i=1,2 . . . n) with respect to a reference R that is provided either by formulating (matching) the master colour V using the toners $T_i$ (i=1,2 . . . n) of the colour copier K or using dyes at least approximately corresponding to the toners or by making a copy of the master colour V using the colour copier when the master colour is in the form of a physical pattern. Surprisingly it has been found that the colour deviation between the original O printed using the relevant printing ink formulation $P_i$ and the copy C thereof made using the colour copier K is at its most marked when the said metamerism M or the index of metamerism or an analogous value between the relevant printing ink formulation $P_i$ and the reference R is at its greatest. By taking into account the metamerism or the index of metamerism or an analogous value between formulation $P_i$ and the said reference R, according to the invention the person skilled in the art is therefore provided with the means to determine simply and quickly the formulation $P_i$ that is most favourable in terms of copying behaviour (that is to say that can be copied with the least colour fidelity) without the need for laborious, time-consuming and ultimately expensive testing. This procedure is illustrated also by the FIGURE shown in the drawings.

The simplest way of producing the said reference R is for the master colour V, in the form of a physical pattern, to be copied using the colour copier. The colour copy made therefore immediately constitutes the reference R the spectrum of which can then be used, together with the (calculated) spectrum of the printing ink formulation in question, to determine the metamerism or index of metamerism in the manner known per se that has already been mentioned above.

Alternatively, the reference can also be determined by formulating (matching) the master colour with the aid of the toners used in the colour copiers using a formulating system, known per se, containing stored spectral data of the toners. The spectrum of the toner formulation so determined can either be taken directly from the formulating system or can be determined by measuring a colour pattern made using that toner formulation.

If the data for the toners is not available it is also possible to use as a replacement instead of the toners substitute dyes that are as close as possible to the toners, especially dyes from the same range as those from which the dyes for the formulation of the printing inks originate. In this case too, the greatest colour deviation on copying is obtained when the said metamerism between the relevant printing ink formulation and the reference is at its greatest.

For master colours outside the colour range attainable with the customary toners, the best results are obtained when the printing inks are formulated with dyes (pigments) that are as pure as possible and that are as far removed as possible from the toners in terms of their optical data. By the use of fluorescent effect pigments, such as "IRGAZIN® Fluorescent Gelb (Fluorescent Yellow) 8501B" mentioned hereinabove, it is possible additionally to increase the effect obtained, especially in the yellow-red range and the yellow-green range.

For master colours within the colour range attainable with the customary toners, it is most effective either when the dulling effect (black component) is produced by complementary mixing or when the black component is formulated by an anisotropic dye, such as the said pigment "GRAPHITAN® 7700,"mentioned hereinabove.

The determination of the metamerism is customarily effected for the CIE types of illumination D65 (daylight) and A (incandescent lamp light). It is of course possible for other types of illumination, which may possibly be more suitable for specific cases, to be used as the basis.

The formulation and determination of the metamerism are preferably effected by means of a suitably programmed computer. p The above-mentioned procedure will be illustrated below with reference to an example. A green is chosen as the desired master colour V.

Colour coordinates of the master colour in the L,a,b-colour space:

76.4 (L-coordinate), −37.5 (a-coordinate), 33.1 (b-coordinate)

Formulations $P_i$, with which that given master colour can be matched, are, for example (all percentages are given in percent by weight):

| | | |
|---|---|---|
| Formulation $P_1$: | 30.0% | IRGAZIN ® Fluoreszent Gelb (Fluorescent Yellow) 8501B (20%), |
| | 20.0% | IRGALITH ® Grün (Green) 6G (8%), |
| | 50.0% | nitrocellulose clear lacquer |
| Formulation $P_2$: | 43.9% | IRGAZIN ® Fluoreszent Gelb (Fluorescent Yellow) 8501B (20%) |
| | 11.6% | IRGALITH ® Grün (Green) GLN (8%) |
| | 44.5% | nitrocellulose clear lacquer |
| Formulation $P_3$: | 13.1% | CROMOPHTAL ® Gelb (Yellow) 3G (8%) |
| | 24.9% | IRGALITH ® Grün (Green) 6G (8%) |
| | 62.0% | nitrocellulose clear lacquer |
| Formulation $P_4$: | 17.8% | CROMOPHTAL ® Gelb (Yellow) 3G (8%) |
| | 14.0% | IRGALITH ® Grün (Green) GLN (8%) |
| | 68.2% | nitrocellulose clear lacquer |

The percentages given in brackets after each pigment indicate that the pigment is not in pure form and that the percentage (% by weight) shown in brackets of a nitrocellulose clear lacquer has been added to the pure pigment. The nitrocellulose clear lacquer added to the pure pigments is the same nitrocellulose clear lacquer as that used as a component for formulating $P_i$.

The nitrocellulose clear lacquer can have the following composition:

8% nitrocellulose A 250 (18% dibutyl phthalate), Union Carbide

1% Ethocel 7cp, DOW

6% synthetic resin AFS, Hüls

20% ethoxypropanol

20% ethyl acetate

45% ethanol

The colour coordinates L,a,b of formulations $P_i$ in the L,a,b-colour space are:

Formulation $P_1$: 83.8 (L-coordinate), −41.9 (a-coordinate), 30.8 (b-coordinate)

Formulation $P_2$: 82.6 (L-coordinate), −44.5 (a-coordinate), 32.7 (b-coordinate)

Formulation $P_3$: 81.4 (L-coordinate), −40.9 (a-coordinate), 32.6 (b-coordinate)

Formulation $P_4$: 80.2 (L-coordinate), −40.9 (a-coordinate), 32.9 (b-coordinate)

For creating reference R of the above-mentioned master colour green having the L,a,b-colour coordinates 76.4 (L-coordinate), −37.5 (a-coordinate), 33.1 (b-coordinate), the original on which the master colour has been printed is copied using the colour copier (e.g. CANON CL 200). The reference R then has the L,a,b-colour coordinates 73.6 (L-coordinate), −31.5 (a-coordinate), 25.3 (b-coordinate).

The indices of metamerism $M_i$ (here i=1, . . . 4) between the formulation $P_i$ in question and the reference R according to DIN are then:

$M_1$=3.7, $M_2$=4.1

$M_3$=3.8

$M_4$=2.6

The greatest index of metamerism occurs for formulation $P_2$. In accordance with the teaching of the invention, that formulation is then selected and used for the original printed article.

For checking purposes, one original printed article is made from each formulation $P_i$ of the master colour. Each of those printed articles is then copied using a colour copier. The resulting colour deviations between each original printed article and its respective copy made using the colour copier in the L,a,b-colour space are:

$\Delta L_1=-10.5$, $\Delta a_1=10.2$, $\Delta b_1=-10.2$ $\Delta L_2=-8.6$, $\Delta a_2=13.9$, $\Delta b_2=-14.2$ $\Delta L_3=-9.2$, $\Delta a_3=7.4$, $\Delta b_3=-7.6$ $\Delta L_4=-7.3$, $\Delta a_4=8.4$, $\Delta b_4=-9.0$ Since the greatest index of metamerism between the original printed article and the reference R of the master colour made using a colour copier occurs in the case of formulation $P_2$, in accordance with the invention when copied that formulation will produce the greatest colour deviation between the original and its copy.

What is claimed is:

1. A method of producing a colored printed article which is clearly visually different from color copies produced therefrom, which method comprises the steps of a) formulating a printing ink from a single dye or a mixture of at least two dyes so that the formulation results in the greatest possible degree of metamerism between the formulated printing ink and a reference ink on the basis of two defined types of illumination, which reference ink is of a type typically used in color copiers; and b) printing at least one characteristic area of said article with said formulated printing ink.

2. A method according to claim 1 wherein the article used in the printing step is a security paper.

3. A method according to claim 2 wherein the security paper is a bank note.

4. A method according to claim 1 wherein an anisotropic black dye is use or co-used for the formulation of the printing ink.

5. A method according to claim 4 wherein an effect dye is used or co-used for the formulation of the printing ink.

6. A method according to claim 5, wherein said effect dye is a fluorescent dye.

7. A method according to claim 1 wherein an effect dye is used or co-used for the formulation of the printing ink.

8. A method according to claim 7, wherein said effect dye is a fluorescent dye.

* * * * *

UNITED STATES PATENT AND TRADEMARK OFFICE

CERTIFICATE OF CORRECTION

PATENT NO. : 6,013,307

DATED : JANUARY 11, 2000

INVENTOR(S) : HANSPETER HAUSER ET AL.

It is certified that error appears in the above-identified patent and that said Letters Patent is hereby corrected as shown below:

On the title page, Section [30] should read:

-- Foreign Application Priority Data

[30] Dec. 3, 1992 [EP] European Pat. Off. 92 810 951 --.

Signed and Sealed this

Thirty-first Day of October, 2000

*Attest:*

*Attesting Officer*

Q. TODD DICKINSON

*Director of Patents and Trademarks*